US005987900A

United States Patent [19]

Love

[11] Patent Number: 5,987,900

[45] Date of Patent: Nov. 23, 1999

[54] METHOD AND SYSTEM FOR PRECHILLING AMBIENT WATERS FOR BEVERAGE DISPENSING MACHINES AND ICE MACHINES

[75] Inventor: Jeff L. Love, Leander, Tex.

[73] Assignee: Maximicer, LLC, Austin, Tex.

[21] Appl. No.: 09/073,469

[22] Filed: May 6, 1998

[51] Int. Cl.[6] ..... F25C 1/12

[52] U.S. Cl. ..... 62/66; 62/348; 62/396

[58] Field of Search ..... 62/348, 344, 396, 62/398, 399, 400, 66

[56] References Cited

U.S. PATENT DOCUMENTS

| | | | |
|---|---|---|---|
| 3,744,263 | 7/1973 | Franck et al. | 62/348 |
| 3,779,029 | 12/1973 | Larriva | 62/348 |
| 4,262,489 | 4/1981 | Sakamoto et al. | 62/348 |
| 4,300,359 | 11/1981 | Koeneman et al. | 62/344 |
| 4,678,104 | 7/1987 | Pritchett | 62/344 |
| 4,848,102 | 7/1989 | Stanfill | 62/348 |
| 4,881,378 | 11/1989 | Bryant | 62/348 |
| 5,230,448 | 7/1993 | Strohmeyer et al. | 62/344 |
| 5,555,734 | 9/1996 | Welch et al. | 62/348 |

*Primary Examiner*—William E. Tapolcai
*Attorney, Agent, or Firm*—Michael P. Breston

[57] ABSTRACT

The system for prechilling the ambient water, derived from a pressurized source of ambient water, that is needed by an existing beverage dispenser machine and by an existing ice maker machine, includes a heat exchanger positioned outside of the dispenser machine. This heat exchanger receives the cold waste waters being discharged during use by both machines. A heat exchange tubing is immersed inside the heat exchanger for precooling, in heat exchange relationship, the needed ambient water with the cold waste water inside the heat exchanger. The prechilled ambient water is supplied to the ice machine for producing ice to fill the dispenser's bin, and the ice is supplied to the bin of the dispenser machine for cooling the dispenser's cold plate and for dispensing chilled beverages.

15 Claims, 1 Drawing Sheet

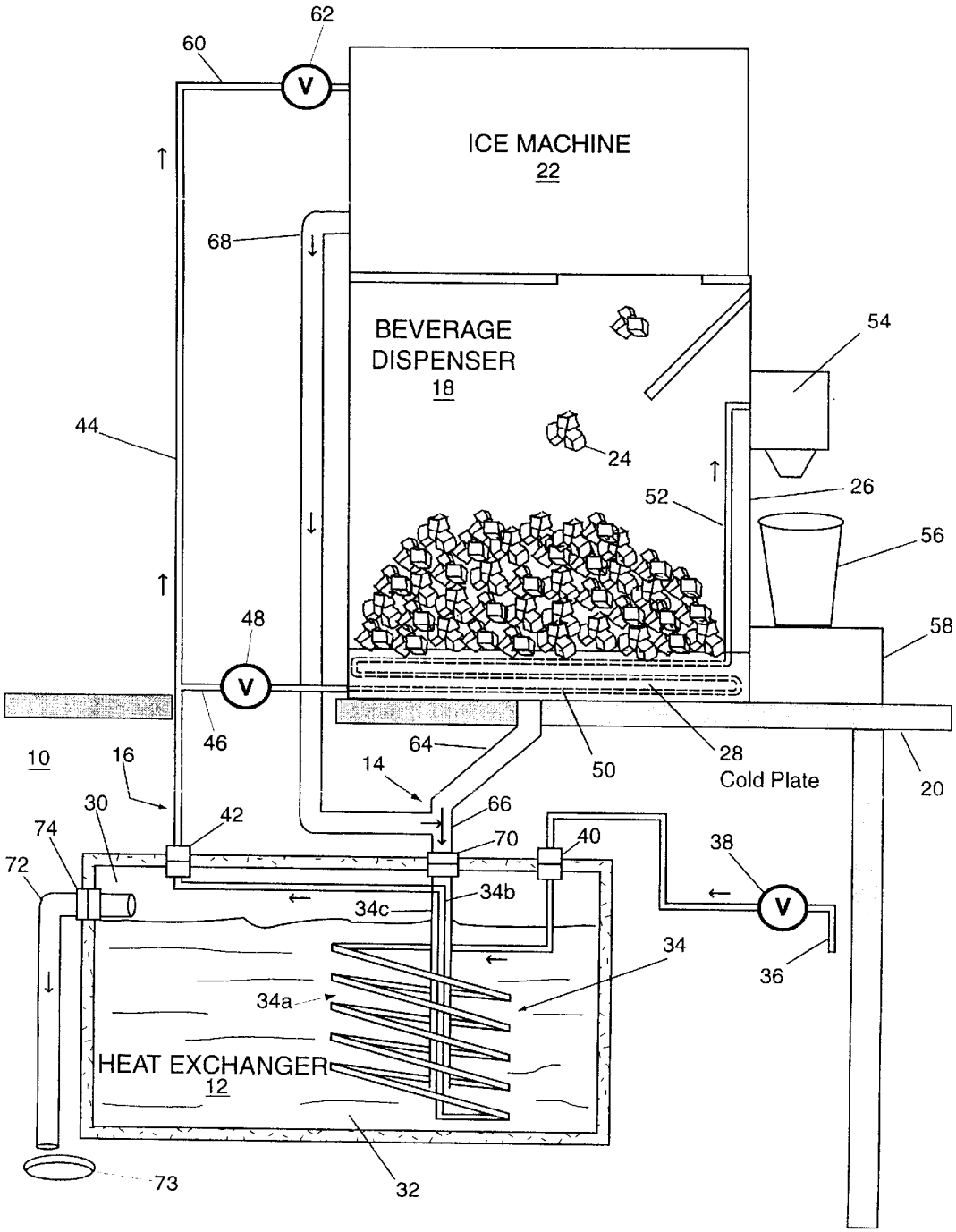
62
60
V
ICE MACHINE
22
68
BEVERAGE
DISPENSER
18
54
44
24
26
52
56
48
58
V
46
64
28
Cold Plate
10
16
14
50
20
30
42
66
74
70
40
38
72
34b
34c
V
34
36
34a
HEAT EXCHANGER
12
73
32

METHOD AND SYSTEM FOR PRECHILLING AMBIENT WATERS FOR BEVERAGE DISPENSING MACHINES AND ICE MACHINES

BACKGROUND OF THE INVENTION (1) Reference to Applicant's Related Patents

Patents U.S. Pat. Nos. 5,379,603 and 5,555,734 of which this applicant is a co-inventor describe a preferred heat exchanger for use with this invention.

(2) Field of the Invention

This invention relates to improvements to existing ice making and beverage dispensing machines that can be easily installed on location to extract the cooling energies embodied within the cold waste waters which are conventionally ejected to the sewer by both machines.

(3) Description of the Prior Art

Beverage dispensers and ice making machines are widely used worldwide especially in warm and hot climates. This invention is not limited to any particular type machine, or combinations thereof. This invention relates not to the machines per se but to novel improvements to existing ice making and beverage dispensing machines. These improvements can be easily installed on location, fixedly or movably, at a convenient out of the way site adjacent to but outside of the machines, so as to preserve precious space allocated to and occupied by the ice storage bin of the beverage dispenser machine.

Efforts to extract the cooling energy embodied within the waste water from a single machine, but not from both machines simultaneously, are described in the patent literature. Such efforts however have not been successful in the market place, except for a water prechiller, known in the trade as MAXIMICER® (a registered trademark of applicant's assignee), for use with ice machines and described in said U.S. Pat. Nos. 5,379,603 and 5,555,734.

It is a primary object of the present invention to extract the cooling energies that are embodied within the cold waste waters conventionally ejected to the sewer when both machines commonly operate in tandem, i.e., the ice machine directly supplies the cooling ice and the food ice to the ice bin of the beverage dispenser. These extracted cooling energies can be simultaneously used to prechill the ambient tap water flowing into the ice machine to make the cooling ice and the food ice for the ice bin of the beverage dispenser machine, and/or to prechill the same ambient tap water used by the beverage dispenser machine in its process of dispensing different kinds of cold beverages at about 40° F. and below. The cooling ice in the ice bin is used by the cold plate of the beverage dispenser machine to cool the different kinds of syrups as well as the tap water all passing through the cold plate in heat exchange relationship with the cooling ice, i.e., the cooling ice is used as the non-mechanical source of cooling energy. On the other hand, the food ice is made available to the public for consumption as in a fast-food restaurant.

A soda drink "goes flat" as the temperature of a particular beverage from the dispenser's cold plate rises because the amount of gas the soda drink can hold decreases as its temperature increases. For the purpose of carbonation, it is desired that the temperature of the dispensed beverage be maintained at about 40° F. or below, which is a very difficult and critical task to accomplish, especially in the hot summer months.

The apparatus and method of this invention are especially useful in fast-food restaurants when the output of the ice maker machine is acutely insufficient to meet the demand by the beverage dispenser for cooling ice and consumption food ice. This demand can only be partially accommodated by using a larger ice machine which uses more energy because ice machines are not designed for rapid recovery. The ice maker machine recovery time is the time required by an ice maker machine to regain a substantially full ice bin after the ice has been removed from the bin.

Naturally, efforts have been made to render the beverage delivery process more energy efficient as will become apparent from the following patents. Such efforts have been largely unsuccessful. These exemplary patents will set the stage for the problems involved to which this invention brings a novel solution.

U.S. Pat. No. 5,226,296, issued Jul. 13, 1993, describes a typical cold plate for cooling different beverages drawn from beverage supply cylinders. The cold plate has a run-off roof, defined by a sloping end, and side sections. The cold plate is received in the well of a thermally-insulated sink, chest or bin having an open bottom bordered by a ledge. The base of the cold plate is seated on the ledge in spaced relation to the sides of the well to define a gutter having a water drain.

Embedded in the cold plate are cooling coils terminating in input and output terminals that project from the underside of the base. The coils' inputs are coupled by upstream lines to respective beverage supply cylinders. The coils' outputs are coupled by downstream lines to a soda valve dispenser to selectively dispense desired cold soda beverages. The thermally-insulated sink is filled with ice cubes covering and being in heat-exchange relationship with the exposed surfaces of the cold plate and with the cooling coils embedded therein to cool the beverages flowing therethrough.

In this manner, heat energy becomes transferred from the warm beverages flowing through the coils to the ice cubes, causing their melt down and a run off of the ice-water mixture from the sloped roof through the gutter and into an exterior drain.

U.S. Pat. No. 5,549,219 describes an apparatus for prechilling and preparing a beverage by directly contacting water and ice in a heat exchanger to cool the water and melt the ice, and to produce an outflow of about 36° F. water as well as ice cold waste water from the melted ice. The outflowing cold water from the prechiller is then carbonated in a carbonator, which is also in heat exchange contact with the ice for keeping the contents of the carbonator cool. The carbonated water is manifolded to individual conduits leading to a plurality of individual soda dispensing nozzles.

U.S. Pat. No. 5,350,086 describes a beverage dispenser having a prechiller for prechilling the incoming ambient water. The prechiller uses tubing means that comprises four inter-connected linear tube segments adjacent to the side walls of the ice bin. The tubing means is embedded within an aluminum body that is locked in place adjacent to the body of the cold plate in a thermal isolating manner. Both bodies are in thermal contact with the ice in the bin of the beverage dispenser.

U.S. Pat. No. 4,798,061 describes an ambient water prechiller used in conjunction with a preexisting beverage system to cool the water input to an ice maker. An electrically driven pump circulates water through concentric tubing immersed in the ice bank of the beverage system to supply cool water to the input line to the ice maker.

U.S. Pat. No. 4,856,678 shows a beverage dispenser using an ice water precooler. The dispenser has a rectangular ice bin in the bottom of which is an aluminum cold plate having vertical apertures to permit waste water from the melting ice on the cold plate to run off into a waste water tank situated immediately underneath the ice storage bin of the beverage dispenser. A helical concentric tubing is immersed in the waste liquid tank. Ambient water is supplied to the innermost tube of the concentric tubing and thereafter to a serpentine passage through the cold plate. A pump is utilized to recirculate the waste water from the tank through a second serpentine passage in the cold plate, through the outer conduit of the concentric tubing, and back to the tank. The outflowing cold water from the prechiller is carbonated in a carbonator which is also in heat exchange contact with the ice for keeping the contents of the carbonator cool. The carbonated water is manifolded to individual conduits leading to a plurality of individual soda dispensing nozzles.

In general, such known tap water prechillers (a) necessarily limit the maximum space that can be allocated for the beverage dispenser's ice bin, and hence the maximum volume of ice that can be stored in the bin, and (b) tend to preclude utilizing an additional source of cooling energy, such as the cold waste water purged from the ice maker machine, due to health hazard concerns about introducing a pool of liquid waste water from the ice maker to within close proximity to the food ice stored in the ice bin of the beverage dispenser. Such use of the liquid waste water from the ice maker might possibly contaminate the food ice in the ice bin and/or the beverages from and/or passing through the dispenser machine's cold plate.

For example, the vertical drain holes proposed by said U.S. Pat. No. 4,856,678 are likely to expose the food ice in the ice bin to contamination from the liquid waste waters stored in the waste water tank positioned in close proximity to the ice bin within the space occupied by the beverage dispenser machine. Also, the space inside the concentric tubing of this patent is likely to become clogged up with minerals, and the submersed electric pump's operational life is likely to become short and its use might be dangerous.

It is a main object of this invention to selectively channel all the cold waste waters, intrinsic in existing beverage dispenser and ice maker machines, to flow into a single waste water heat exchanger that is positioned on location at a convenient out of the way site, so as to be physically separated from and outside of the space occupied by the frame structure of the beverage dispenser machine. As a direct consequence thereof the present invention (a) does not limit the maximum space that can be allocated for the beverage dispenser's bin, and hence the maximum volume of ice that can be stored in the bin, (b) minimizes the health hazard concerns, based on exposing the food ice in the ice bin of the beverage dispenser machine to possible contamination, because the pool of liquid waste waters from the ice maker and the liquid waste water from the beverage dispenser machines are safely stored within the thermally-isolated chamber of a heat exchanger preferably positioned and serviced outside of the frame structure of the beverage dispenser machine, (c) can selectively utilize the additional cooling energy which is embodied within the purge cold waste water discharged during every ice-making cycle of the ice machine, (d) can achieve the desired prechill temperatures in shorter time intervals, and thus accelerate recovery times at periods of high volume beverage and ice food usage, (e) can reduce the melting of ice in the drink dispenser's ice bin, thus reduce energy consumption and increase both the availability of food ice and the availability of ice as the coolant source of the beverage dispenser's cold plate, (f) can increase the ice production in the ice machine which increases both the availability of food ice and the availability of ice as the coolant source for the cold plate, and (g) effectively reduces ice melting in the dispenser machine's bin, reduces energy and ice consumption by the dispenser machine, and substantially increases, without additional energy costs, the ice output by the ice maker machine and the volume of beverage output by the beverage dispenser.

SUMMARY OF THE INVENTION

The novel system and process prechills the tap water used by an existing beverage dispenser machine and by an existing ice maker machine, both machines discharging cold waste waters to individual conduits leading an external drain. The individual streams of cold waste waters from both machines are channeled into a heat exchanger chamber in heat exchange relationship with the tap water, as by the use of copper or stainless steel tubing through which the tap water is made to flow from a pressurized water source.

The outflowing cooler water from the heat exchanger is distributed to individual water conduits leading to the ice maker machine and to the beverage dispenser machine.

The heat exchanger is positioned at a preferred convenient site, physically separate from and outside of the space occupied by the frame structure of the beverage dispenser machine.

The heat exchange tubing means preferably comprises two inter-connected tube segments one substantially linear and one helical. The tubing means is immersed within the pool of cold waste water inside the heat exchanger chamber so that both tube sections are in heat exchange relationship with the waste water. The helical segment is adjacent to the wall of the heat exchanger chamber and is followed by the linear segment within and surrounded by the helical segment. A hollow thermally-insulated tube is mounted in spaced relation to the linear tubing section and to be surrounded by the helical section. Preferably, the linear section extends through the inside of the thermally-insulated tube.

BRIEF DESCRIPTION OF THE DRAWINGS

The sole FIGURE shows a schematic diagram of the novel method and system for prechilling the ambient water prior to feeding it to the for beverage dispenser and ice maker machines.

DESCRIPTION OF THE INVENTION

General Description (In the following text, a conduit and the liquid flowing through the conduit will be designated with the same reference character to simplify the technical description.)

The novel system 10 of this invention is for prechilling the incoming tap water 36 before it is used by an existing beverage dispenser machine 18 and/or by an existing ice maker machine 22. Both machines discharge, as by-products, cold waste waters to an external drain 73.

System 10 preferably includes a single heat exchanger 12 for serving the prechilled water needs of both machines 18 and 22. Exchanger 12 receives from both machines their cold waste waters 64 and 68 and forms a waste water pool 32, which is in heat exchange relationship with the ambient tap water 36. During the exchange process, the tap water 36 progressively becomes cooler, while the waste water 32 progressively warms up. Heat exchanger 12 outputs its prechilled water 44 to the machines 18 and 22, and also outputs the warmed up waste water 72 to an external drain 73.

This heat exchange process continuously and effectively minimizes the melting of ice in the beverage dispenser's ice bin 26, reduces energy consumption by both machines, increases the availability of food ice for consumption, increases the availability of ice as the coolant source for the beverage dispenser's cold plate 28, and increases the ice output from the ice maker 22, without incurring additional energy costs. This heat excahnge process uses only the passive heat exchanger 12, which is preferably installed at a convenient out of the way location, so that it becomes physically separated from and outside of the space occupied by the frame structure of the beverage dispenser machine 18.

The heat exchanger 12 has a chamber 30 which receives the waste waters 66 and 68 that form the water pool 32. A copper or stainless steel heat exchange tubing means 34 receives the incoming ambient tap water 36 in heat exchange relationship with waste water pool 32 for supplying the cooler water 44 to the machines 18 and 22.

Detailed Description

The novel prechilling system 10 includes the thermally-insulated heat exchanger 12, a channeling means 14, and a distribution means 16. Heat exchanger 12 is shaped depending on the available space on location. It is positioned at a convenient out of the way site, say under countertop 20, so that it is physically separate from and stationed outside of the frame structure of the beverage dispenser system 18.

System 10 is adapted for use with machines using water cooling means, such as a beverage dispenser system 18 that sits on a countertop 20, and/or an ice maker machine 22 that is attached to the top of dispenser machine 18 and chutes down its output ice 24 directly into the dispenser's thermally-insulated ice bin 26, at the bottom of which is mounted a typical dispenser cold plate 28.

System 10 can be easily installed on location by selectively and fluidly coupling heat exchange chamber 30 to different kinds of beverage dispenser and ice maker machines 18 and 22 using channeling means 14 and distribution means 16. The chamber 30 has a sufficient volume of cold waste water 32 in which is submersed the heat exchange tubing means 34 for precooling the incoming ambient water. It arrives from a pressurized water source 36, such as city water, through a 2-way valve 38, an intake coupler 40, and into the intake end of the heat exchange tubing 34. The water 36 then continues to flow along a path of sufficient tubing length so that it can be in heat exchange relationship with the cold waste water 32 for a sufficient duration to sufficiently lower the temperature of the prechilled water 44 that flows out from the discharge end of the heat exchange tubing 34 through a discharge coupler 42 into a main distribution line 44 of the distribution means 16.

A branch line 46 feeds the water 44 through a 3-way valve 48 to the input terminal of a serpentine water passage 50 inside the beverage dispenser's cold plate 28. The output terminal of passage 50 feeds cold water through a downstream line 52 to a soda valve dispenser 54 for selectively dispensing a desired soda beverage into a cup 56 sitting on a drink overflow trough 58.

In this manner, heat energy becomes transferred from the tap water 36 to the cold pool waste water 32, and heat energy becomes transferred again from the relatively warmer water 46 flowing through passage 50 to the ice 24 covering cold plate 28 in ice bin 26, thereby causing a progressive melt down of the ice 24.

Another branch line 60 feeds the water 44 from the main distribution line 44 through a 3-way valve 62 to the inlet of the ice maker machine 22.

The cold waste water from the ice 24 melting naturally in ice bin 26, and the cold waste water from the ice 24 melting due to the operation of the cold plate 28, both drain into a branch drain line 64 leading to a main drain line 66.

The cold purge water from the ice maker machine 22, which is generated each time the ice maker machine cycles, drains into a branch line 68 also feeding to main drain line 66 that feeds through a coupler 70 all the collected cold waste waters into heat exchange chamber 30 to form the pool 32.

The drain lines 64, 66, 68 drain their cold waste waters by gravity to the heat exchange chamber 30 without the need for a pump. An overflow relief line 72 is coupled to the heat exchange chamber 30 through a coupler 74 to prevent the pool 32 from reaching an excessive level.

The tubing means 34 preferably comprises two interconnected tube segments, one 34*b* substantially linear, and the other 34*a* substantially helical. The tubing means 34 is immersed within the waste water pool 32. Both tube sections 34*a* and 34*b* are in heat exchange relationship with the waste water pool 32 in the chamber 30. The helical segment 34*a* is adjacent to the walls of chamber 30 and it is followed by the linear segment 34*b* within and surrounded by the helical segment 34*a*. A hollow thermally-insulated tube 34*c* is in spaced relation to the linear tubing section 34*b* to be surrounded by the helical section 34*a*. Preferably, the linear section 34*b* extends through the inside of the thermally-insulated tube 34*c*.

In the heat exchanger 12, heat energy becomes transferred from the warm ambient tap water 36, flowing into and through the heat exchange tubing means 34, to the icy waste water 32 surrounding the heat exchange tubing means 34, thereby causing a progressive increase in the temperature of the waste water 32 up to the top surface of the body of waste water 32, whereat it has its highest temperature, and conversely, causing a progressive decrease in the temperature of the tap water 36 flowing in tubing means 34 up to its outlet, whereat the output water 44 has its lowest temperature.

The heat exchange tubing means 34 is a very efficient and compact 2-stage precooler because the tap water 36 is first cooled within the coiled section 34*a* by the cold waste water 32, and then again cooled within the straight section 34*b* with the fresh cold waste water 66 draining into the thermally-insulated tube 34*c* which surrounds linear tube section 34*b*. From tube 34*c* the waste water 32 is discharged to the bottom of chamber 30.

The preferred heat exchange tubing means 34 and the preferred inlet and outlet coupling connectors 40,42, 70 and 72, which are made of a plastic material to minimize mineral deposits in chamber 30, are more fully described in said applicant's U.S. Pat. Nos. 5,379,603 and 5,555,734.

It will be appreciated that system 10 can be movably stationed on location, if necessary, outside of the frame structure of the beverage dispenser 18, which should avoid any possible health hazard concerns from the likelihood of contamination of the food ice which is maintained inside the beverage dispenser's ice bin, and from liquid waste waters originating from and/or passing through the dispenser's cold plate 28.

System 10 does not limit the space available for ice bin 20, nor does it limit the amount of ice the bin can contain. In so doing, system 10 frequently can avoid the need for a larger ice machine, to compensate for a smaller ice bin size, which would be the case if heat exchanger 12 were installed inside the frame structure of the beverage dispenser 18.

System 10 can utilize in a novel method all the waste water cooling energies, intrinsic in existing beverage dispenser and ice maker machines, for prechilling the ambient tap waters needed by such machines. Hence, system 10 can substantially save on electric energy costs while at the same time outputting more ice, more cold beverages, and achieving lower prechill tap water temperatures in shorter time intervals, thus accelerating recovery times at periods of high volume beverage usage.

System 10 minimizes the melting of ice 24 in the drink dispenser's bin 26, thus increasing the availability of ice, which serves as the coolant source for cold plate 28 and as food ice for consumption.

By synergetically using the cold waste waters stemming from both machines 18 and 22, the consumer will receive a satisfying chilled drink of sufficient carbonation and of consistent quality.

A test was performed on a Cornelius 8-valve drink dispenser machine combined with a Cornelius 600 lb. ice maker machine attached to the top of the ice bin. The cold waste water from the ice melting in ice bin 26 and the cold waste water from the ice melted by the dispenser cold plate 28, both flowing through pipe 64, were combined with the cold purge water 68 from the ice machine 22, which is generated each time the ice maker machine cycles, to constitute the cold waste water pool 32, which prechills the tap water 36 into cooler water 60 for use by the ice making section of ice maker 22. The average temperature of the water 60 was 51° F., compared to the average 83° F. tap water 36 thus obtaining a 32° F. temperature reduction, substantial energy savings, and reduced machinery costs.

Other advantages will readily become apparent to those skilled in the art.

What I claim is:

1. A method for prechilling the ambient water from a pressurized source that is needed by an existing beverage dispenser machine, having an ice bin and a cold plate, and for prechilling said ambient water that is needed by an existing ice maker machine, comprising:

receiving in a heat exchanger the cold waste waters being discharged during the use of both said machines, and said heat exchanger having a heat exchange tubing means immersed in said received cold waste waters;

receiving said ambient water in said tubing means, in heat exchange relationship with said received cold waste waters, thereby prechilling said ambient water flowing through said tubing means; and supplying said prechilled ambient water from said tubing means to said ice machine for producing ice to fill said ice bin, and supplying said prechilled water to said cold plate for producing beverages.

2. A method for prechilling the ambient water from a pressurized source that is needed by an existing beverage dispenser machine having an ice bin and a cold plate, comprising:

positioning a heat exchanger outside of said beverage dispenser machine;

receiving in said heat exchanger the cold waste water being discharged during the use of said machine, and said heat exchanger having a heat exchange tubing means immersed in said received cold waste water;

receiving said ambient water in said tubing means, in heat exchange relationship with said received cold waste water, thereby prechilling said ambient water flowing through said tubing means; and supplying said prechilled ambient water from said tubing means to said cold plate for producing beverages.

3. The method for prechilling the ambient water according to claim 1, and positioning said heat exchanger outside of said beverage dispenser machine.

4. The method for prechilling the ambient water according to claim 1, wherein said heat exchange tubing means includes at least in part a coil having a plurality of spiral turns followed by a substantially straight tube portion.

5. The method for prechilling the ambient water according to claim 4, wherein said straight tube portion is within and surrounded by said coil turns.

6. The method for prechilling the ambient water according to claim 5, and a hollow thermally-insulated member mounted in spaced relation to said straight tube portion to be surrounded by said coil's turns.

7. A system for prechilling the ambient water from a pressurized source that is needed by an existing beverage dispenser machine having an ice bin and a cold plate, comprising:

a heat exchanger positioned outside of said machine for receiving the cold waste water being discharged during the use of said machine;

a heat exchange tubing means, immersed is said received cold waste water, for receiving said ambient water in heat exchange relationship with said received cold waste water;

said heat exchanger prechilling said ambient water flowing through said tubing means; and means for supplying said prechilled water from said tubing means to said cold plate for producing beverages.

8. A system for prechilling the ambient water from a pressurized source that is needed by an existing beverage dispenser machine, having an ice bin and a cold plate, and for prechilling said ambient water that is needed by an existing ice maker machine, comprising:

a heat exchanger for receiving the cold waste waters being discharged, in use, by both machines;

a heat exchange tubing means, immersed is said received cold waste waters, for receiving said ambient water in heat exchange relationship with said received cold waste waters;

said heat exchanger prechilling said ambient water flowing through said tubing means; and means for supplying said prechilled water from said tubing means to said ice machine for producing ice to fill said ice bin, and for supplying said prechilled water to said cold plate for producing beverages.

9. The system for prechilling the ambient water according to claim 8, wherein said heat exchange tubing means includes at least in part a coil having a plurality of spiral turns followed by a substantially straight tube portion, and said straight tube portion is within and surrounded by said coil turns.

10. The system for prechilling the ambient water according to claim 9, and a hollow thermally-insulated member mounted in spaced relation to said straight tube portion to be surrounded by said coil's turns.

11. The system for prechilling the ambient water according to claim 8, and means for channeling said cold waste waters from said machines into said heat exchanger; and said channeling means being positioned outside of said beverage dispenser machine.

12. A system for prechilling the tap water needed by an existing beverage dispenser machine and by an existing ice maker machine, both said machines discharging during use cold waste waters to individual conduits, comprising:

a heat exchanger having a chamber and heat exchange tubing means, and being positioned at a location separated from and outside of said beverage dispenser machine;

means for channeling said cold waste waters from said individual conduits into said chamber;

means for supplying said tap water to said tubing means;

said tubing means including a substantially linear tube segment and a helical tube segment, and both said tube segments being immersed within said waste water inside said chamber so that both said tube segments become in heat exchange relationship with said waste water; and means for distributing the outflowing cooler tap water from said tubing means to individual water conduits leading to said ice maker machine and to said beverage dispenser machine.

13. The system for prechilling the tap water according to claim 12, wherein said helical segment being adjacent to the wall of said chamber and being followed by said linear segment within and surrounded by said helical segment; and a hollow thermally-insulated tube being mounted in spaced relation to said linear tubing segment to be surrounded by said helical segment.

14. A system for prechilling the ambient water, derived from a pressurized source of ambient water, that is needed by an existing beverage dispenser machine and by an existing ice maker machine, said beverage dispenser machine having an ice bin and a cold plate, comprising:

a heat exchanger positioned outside of said dispenser machine for receiving the cold waste waters being discharged during use by both said machines;

a heat exchange tubing means immersed inside said heat exchanger for prechilling, in heat exchange relationship, said ambient water with said cold waste water inside said heat exchanger;

means for distributing said prechilled ambient water (1) to said ice machine for producing ice to fill said dispenser's bin, and (2) to said dispenser's cold plate for producing beverages; and said distributing means being positioned outside of said dispenser machine.

15. A system for prechilling the ambient water, derived from a pressurized source of ambient water, that is needed by an existing beverage dispenser machine and by an existing ice maker machine, said beverage dispenser machine having an ice bin and a cold plate, comprising:

a heat exchanger positioned outside of the dispenser machine for receiving the cold waste waters being discharged during use by both said machines;

a heat exchange tubing means immersed inside the heat exchanger for prechilling, in heat exchange relationship, said ambient water with said cold waste water inside said heat exchanger;

means for distributing said prechilled ambient water (1) to said ice machine for producing ice to fill said dispenser's bin, and (2) to said dispenser's cold plate for producing beverages, and said distributing means being positioned outside of said dispenser machine;

said heat exchange tubing means including at least in part a coil having a plurality of spiral turns followed by a substantially straight tube portion, and said straight tube portion being within and surrounded by said coil turns; and a hollow thermally-insulated member mounted in spaced relation to said straight tube portion to be surrounded by said coil's turns.

* * * * *